US009144803B2

(12) United States Patent
Davis et al.

(10) Patent No.: US 9,144,803 B2
(45) Date of Patent: Sep. 29, 2015

(54) SHREDDER WITH MULTI-POINT CUTTERS

(75) Inventors: Roswell Davis, Sophia, NC (US); Stefan Kaiser, Greensboro, NC (US); Gary Kolbet, High Point, NC (US)

(73) Assignee: Vecoplan LLC, Archdale, NC (US)

( * ) Notice: Subject to any disclaimer, the term of this patent is extended or adjusted under 35 U.S.C. 154(b) by 910 days.

(21) Appl. No.: 13/168,265

(22) Filed: Jun. 24, 2011

(65) Prior Publication Data

US 2012/0325950 A1 Dec. 27, 2012

(51) Int. Cl.

| | |
|---|---|
| ***B02C 18/18*** | (2006.01) |
| ***B02C 18/14*** | (2006.01) |
| ***B02C 18/00*** | (2006.01) |

(52) U.S. Cl.

CPC ..... *B02C 18/145* (2013.01); *B02C 18/0084* (2013.01); *B02C 18/18* (2013.01); *B02C 2018/188* (2013.01)

(58) Field of Classification Search

CPC .. B02C 18/18; B02C 18/145; B02C 2018/188
USPC ..... 241/242, 243; 407/56, 58, 59, 29.13
See application file for complete search history.

(56) References Cited

U.S. PATENT DOCUMENTS

| | | | | |
|---|---|---|---|---|
| 321,007 | A | | 6/1885 | Chapin |
| 1,144,665 | A | | 6/1915 | North |
| 1,144,666 | A | | 6/1915 | North |
| 1,185,926 | A | | 6/1916 | North |
| 1,713,609 | A | | 5/1929 | Krider |
| 2,183,224 | A | | 12/1939 | Norman |
| 4,394,983 | A | | 7/1983 | Ulsky |
| 4,747,552 | A | * | 5/1988 | Takasaki ..... 241/292.1 |
| 4,779,811 | A | * | 10/1988 | Takasaki ..... 241/293 |
| 4,826,090 | A | | 5/1989 | Orphall |
| 5,269,355 | A | | 12/1993 | Bowen |
| 5,873,534 | A | | 2/1999 | Shinn |
| 5,911,374 | A | | 6/1999 | Biehn |
| 5,927,622 | A | | 7/1999 | Zoellinger |
| 6,176,445 | B1 | | 1/2001 | Shinn |
| 6,305,623 | B1 | * | 10/2001 | Sotsky et al. ..... 241/73 |
| 6,332,012 | B1 | | 12/2001 | Petit |
| 6,343,755 | B1 | | 2/2002 | Barclay et al. |
| 6,435,434 | B1 | | 8/2002 | Monyak |
| 6,695,240 | B2 | | 2/2004 | Rajewski |
| 6,837,453 | B2 | * | 1/2005 | Sturm ..... 241/243 |
| 6,840,471 | B2 | | 1/2005 | Roozeboom et al. |

(Continued)

FOREIGN PATENT DOCUMENTS

| | | |
|---|---|---|
| DE | 9 017 301 U1 | 3/1991 |
| DE | 43 16 147 A1 | 11/1994 |

(Continued)

*Primary Examiner* — Faye Francis
(74) *Attorney, Agent, or Firm* — Alston & Bird LLP

(57) ABSTRACT

A shredder includes a rotor supporting a plurality of multi-point cutters that mesh with a counter-knife having generally V-shaped grooves. Each cutter has at least one corner defined by an intersection between two contiguous side faces of the body of the cutter. The corner defines a plurality of cutting points spaced apart along a first direction. The cutters are mounted on the outer peripheral surface of the rotor such that the first direction of each cutter is substantially tangent to the outer peripheral surface, and such that the corners of the cutters mesh with respective V-shaped grooves in the counter-knife as the rotor rotates about its axis. The multiple points of each cutter encounter and mesh with the groove in the counter-knife in a sequential fashion.

17 Claims, 13 Drawing Sheets

(56) References Cited

U.S. PATENT DOCUMENTS

| | | | | |
|---|---|---|---|---|
| 6,854,676 | B2 | 2/2005 | Dubech et al. | |
| 7,004,413 | B2 * | 2/2006 | Langlois | 241/242 |
| 7,055,770 | B2 | 6/2006 | Bardos | |
| 7,137,583 | B2 | 11/2006 | Kammerer | |
| 7,204,442 | B2 | 4/2007 | Roozeboom et al. | |
| 7,434,756 | B2 * | 10/2008 | Sotsky | 241/283 |
| 7,448,567 | B2 | 11/2008 | Roozeboom et al. | |
| 7,578,462 | B2 | 8/2009 | Edwards | |
| 7,624,490 | B2 | 12/2009 | Bardos | |
| 7,815,136 | B2 | 10/2010 | Arnston | |
| 7,959,099 | B1 * | 6/2011 | Cox et al. | 241/294 |
| 8,061,642 | B2 * | 11/2011 | Chang | 241/294 |
| 8,430,009 | B2 * | 4/2013 | Micacchi | 83/837 |
| 2001/0040198 | A1 | 11/2001 | Rossler | |
| 2006/0102761 | A1 * | 5/2006 | Maynard | 241/224 |
| 2010/0096483 | A1 | 4/2010 | Bardos | |

FOREIGN PATENT DOCUMENTS

| | | | |
|---|---|---|---|
| DE | 44 43 275 | A1 | 6/1996 |
| DE | 298 23 110 | U1 | 5/2000 |
| DE | 20 2007 007546 | U1 | 8/2007 |
| DE | 10 2007 018573 | A | 10/2008 |
| EP | 0 419 919 | B1 | 12/1993 |
| EP | 0 767 004 | A1 | 4/1997 |
| EP | 0 809 533 | B1 | 12/1997 |
| EP | 1 166 875 | A2 | 1/2002 |
| JP | 2001-079437 | A | 3/2001 |
| WO | WO 96/25231 | A1 | 8/1996 |
| WO | WO 2007/125557 | A1 | 11/2007 |
| WO | WO 2011/006666 | A2 | 1/2011 |

* cited by examiner

SHREDDER WITH MULTI-POINT CUTTERS

BACKGROUND OF THE INVENTION

The invention relates to rotary shredders for shredding various materials, comprising a rotor and a counter knife.

Rotary shredders are used for shredding a variety of materials such as paper, cardboard, plastic film, cloth, webbing, textile fibers of natural or synthetic material, waste, and others. European Patent EP 419 919 B1 describes a shredder for such materials that includes a rotor having a plurality of circumferential ribs spaced apart along its length and a counter knife having teeth axially aligned with the valleys or grooves defined between the ribs of the rotor. A plurality of cutters are mounted in pockets formed in the outer surface of the rotor. Each cutter has two faces that are at a right angle to each other and form a V-shape that meshes with a correspondingly V-shaped recess between two adjacent teeth of the counter knife. Material fed into the space between the rotor and counter knife is cut into pieces by the cutters and the pieces pass through a screen that surrounds a portion of the circumference of the rotor; pieces too large to pass through the screen are carried by the rotor back to the counter knife to be cut again.

Further improvements in shredders of the above-noted type would be desirable.

BRIEF SUMMARY OF THE DISCLOSURE

The present disclosure is directed to a shredder generally of the type noted above. In one embodiment, a shredder in accordance with the present disclosure comprises at least one rotor rotatable about an axis and having an outer peripheral surface that extends about the axis, a plurality of cutter holders rigidly affixed to the outer peripheral surface of the rotor at locations spaced circumferentially apart and spaced axially along a length of the rotor, a plurality of cutters respectively mounted to the cutter holders, and a stationary counter-knife mounted adjacent the outer peripheral surface of the rotor and extending the length of the rotor, the counter-knife defining a plurality of generally V-shaped grooves spaced apart along the counter-knife, each V-shaped groove being aligned with at least one of the cutters.

The cutters each comprise a rigid body having a plan shape as viewed along a first direction, each cutter being mounted on a respective one of the cutter holders with the first direction oriented substantially tangent to the outer peripheral surface of the rotor. The body of each cutter defines a corner shaped to be complementary to a respective one of the V-shaped grooves in the counter-knife. The cutters are each mounted in an orientation such that the corner meshes with the respective V-shaped groove in the counter-knife as the rotor rotates about the axis. At least some of the cutters are multi-point cutters in which the corner of the cutter defines a plurality of cutting points spaced apart along the first direction, the plurality of cutting points of each multi-point cutter being arranged to sequentially mesh with the respective V-shaped groove in the counter-knife as the rotor rotates.

In one embodiment, the cutters are mounted on the cutter holders by releasable fasteners permitting the cutters to be removed and replaced as needed. In this regard, the body of each cutter has a bore extending through the body along the first direction for receiving a respective one of the releasable fasteners, and the cutter holders have corresponding bores for receiving the fasteners to mount the cutters to the cutter holders. For example, the bore in the cutter can be internally threaded, and the fastener can be an externally threaded bolt that is passed through a back side of the cutter holder and screwed into the cutter. Alternatively, the top face of the cutter can have a recess for receiving the head of the bolt, and the bolt can be passed through the cutter and then through the cutter holder, with a nut securing the bolt at the back side of the cutter holder. Thus, the invention is not limited to any particular technique for fastening the cutters.

Multi-point cutters of various embodiments are possible. For example, the multi-point cutters can include cutters that define two cutting points spaced apart along the first direction, and/or can include cutters that define three cutting points spaced apart along the first direction, and/or can include cutters that define four (or more) cutting points spaced apart along the first direction.

In some embodiments, the cutter defines a plurality of corners, and every corner defines a plurality of cutting points spaced apart along the first direction. The cutter can be, for example, substantially square in plan shape, having four corners each defining a plurality of cutting points. When one corner wears to the point of needing replacement, the fastener can be released and the cutter can be rotated 90° to present a fresh corner for meshing with the counter-knife. This process can be repeated until all four corners have been used, and then the cutter can be replaced with a new cutter.

In a particular exemplary embodiment, each multi-point cutter has a central axis that is parallel to the first direction, and the corner of each multi-point cutter that meshes with the counter-knife is defined by an intersection between two contiguous side faces of the body. A topmost cutting point of the cutter is defined by an intersection between the two side faces and a top face of the body all coming together at the topmost cutting point. The corner includes a tapered relief portion that begins immediately at the topmost cutting point and tapers inwardly toward the central axis of the cutter, such that the topmost cutting point is farther from the central axis than is any part of the relief portion. A second cutting point of each multi-point cutter is defined below the relief portion, the second cutting point being farther from the central axis than is a lower part of the relief portion adjacent to the second cutting point. The second cutting point can extend the same distance from the central axis as does the topmost cutting point, or alternatively can extend a different distance from the central axis than does the topmost cutting point.

In a further embodiment, the cutter can include a tapered second relief portion that begins immediately at the second cutting point and tapers inwardly toward the central axis of the cutter, such that the second cutting point is farther from the central axis than is any part of the second relief portion. A third cutting point of each multi-point cutter can be defined below the second relief portion, the third cutting point being farther from the central axis than is a lower part of the second relief portion adjacent to the third cutting point.

In a still further embodiment, the cutter can include a tapered third relief portion that begins immediately at the third cutting point and tapers inwardly toward the central axis of the cutter, such that the third cutting point is farther from the central axis than is any part of the third relief portion. A fourth cutting point of each multi-point cutter can be defined below the third relief portion, the fourth cutting point being farther from the central axis than is a lower part of the third relief portion adjacent to the fourth cutting point. As noted, there can be more than four cutting points in some embodiments. In any of the various embodiments, the various cutting points of the multi-point cutter can all extend the same distance from the central axis or can extend different distances from the central axis.

In one embodiment, the top face of the body of the cutter is concave toward the first direction. An optional generally conical protrusion can project upwardly from the top face, and the bore that receives the fastener for fastening the cutter to a cutter holder can extend through the protrusion. In one embodiment the bore is internally threaded for receiving an externally threaded fastener.

Alternatively, the top face of the cutter can be flat.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION OF THE DRAWINGS

The present invention now will be described more fully hereinafter with reference to the accompanying drawings in which some but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Figure 1:
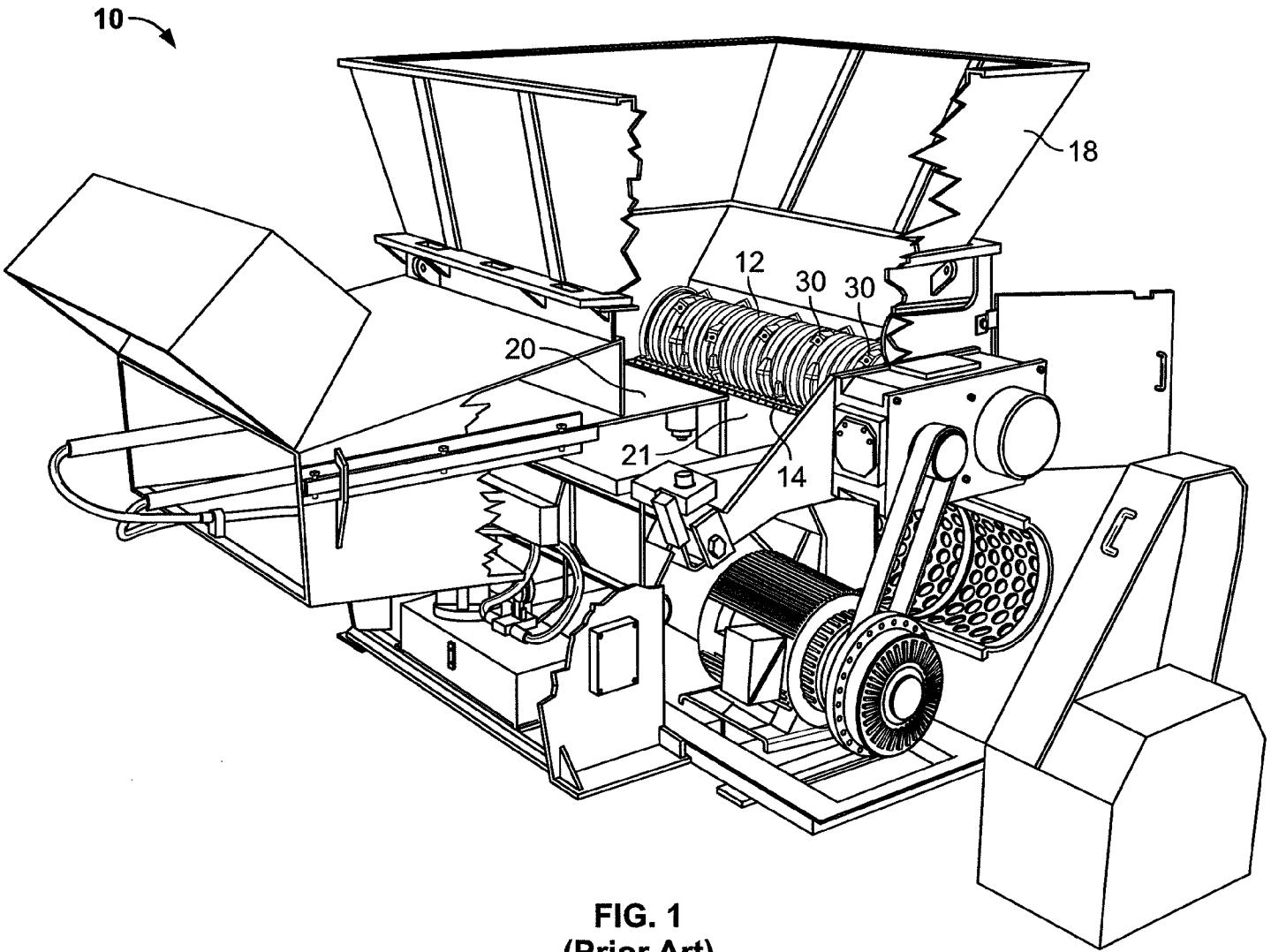
FIG. 1 (Prior Art)
FIG. 1 is a perspective view, partially broken away, of a single-shaft shredder that does not include multi-point cutters in accordance with the present invention.
Figure 2:
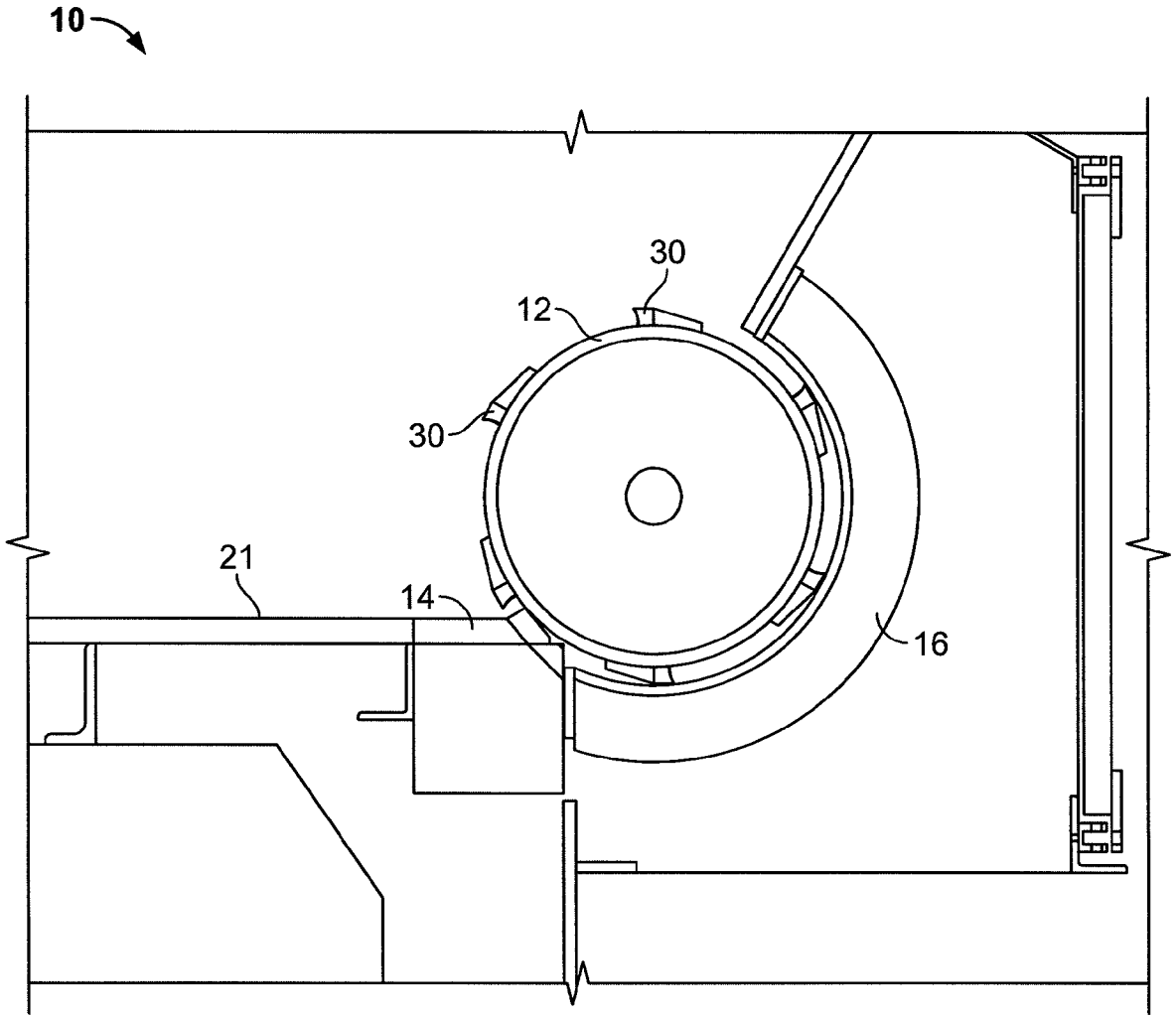
FIG. 2 (Prior Art)
FIG. 2 is a generally schematic end view of the rotor and counter-knife of the shredder of FIG. 1.
Figure 3:
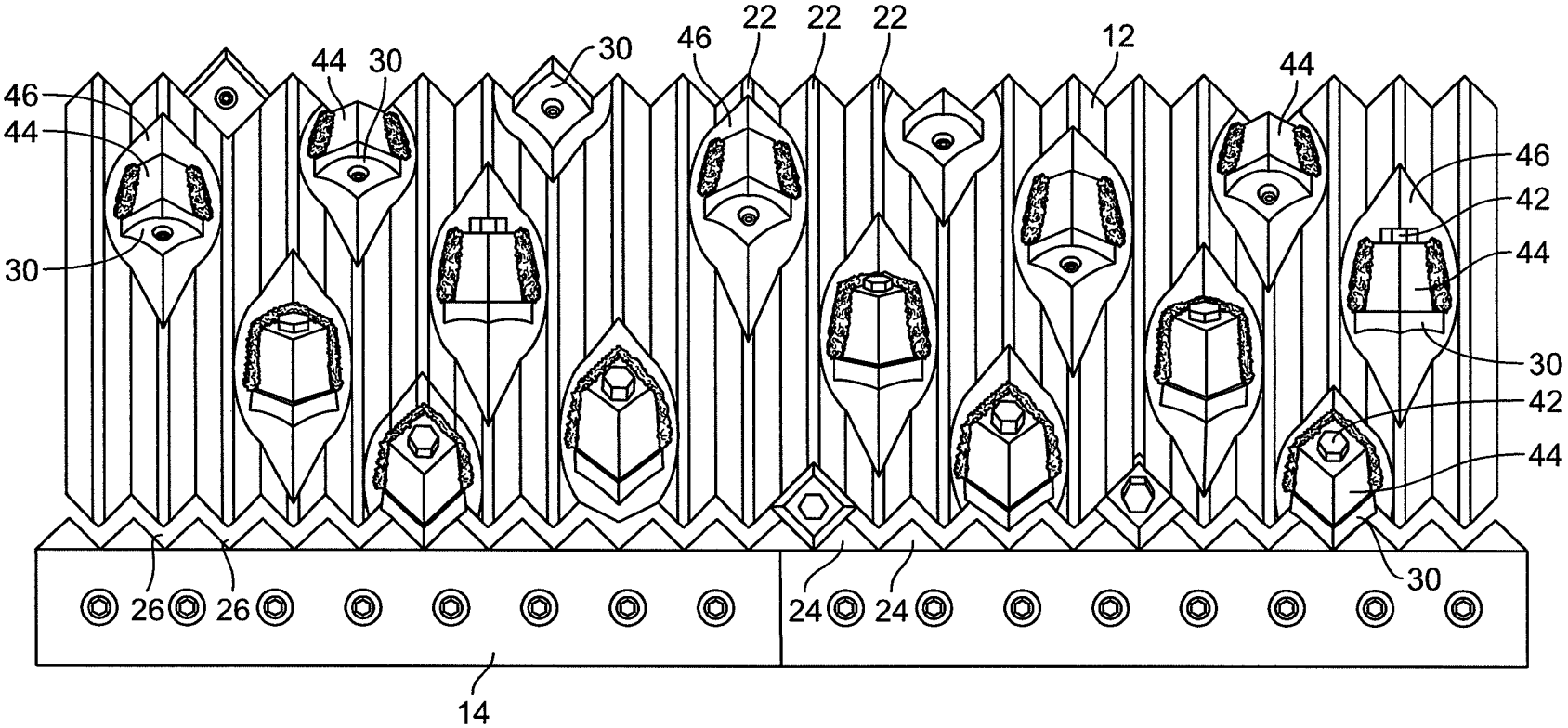
FIG. 3 (Prior Art)
FIG. 3 is a top view of the rotor and counter-knife of the shredder of FIG. 1.

A shredder 10 that does not embody the present invention is depicted in FIGS. 1 through 3. The primary components of the shredder are a rotor 12 that carries cutters 30 as further described below, and a counter knife 14 that works in conjunction with the rotor to grind up or shred material fed into the space where the rotor and counter knife converge. The counter knife is generally stationary, although it can be flexibly supported so that it can "give" to some extent when a very hard object (e.g., a piece of metal or a rock) is inadvertently fed into the space between the rotor and counter knife, the flexibility thereby tending to prevent damage to the machine. The ground up or shredded material exits through a screen 16 (FIG. 2) having apertures suitably sized to regulate the size of the pieces of shredded material. The shredder 10 also includes a hopper 18 for receiving material to be shredded, and a hydraulic ram 20 or the like for feeding the material into the space between the rotor and counter knife. Gravity causes material in the hopper 18 to fall down onto a horizontal plate 21, and the ram 20 pushes the material on the plate 21 toward the rotor 12.

FIG. 3 shows a top view of a portion of the length of the rotor 12 and counter knife 14. The rotor 12 is generally cylindrical in form, but the outer surface of the rotor defines a series of circumferential ridges or ribs 22 that project radially outwardly. In the illustrated embodiment, each rib has opposite side faces that are conical and oppositely inclined to the rotor axis. Thus, in the axial direction along the rotor, the outer surface defines a series of alternating peaks (where the ribs 22 are) and valleys between the peaks. The counter knife 14 has a series of teeth 24 that are axially aligned with the valleys between the ribs 22 of the rotor, there being one such tooth 24 for every valley in the rotor surface. Correspondingly, there are V-shaped recesses or grooves 26 between the teeth 24 of the counter knife that are axially aligned with the ribs 22 of the rotor; thus, the rotor surface and the counter knife are generally complementary in configuration.

With reference to FIG. 3, mounted to the outer surface of the rotor are a plurality of cutters 30 that are axially aligned with the ribs 22 and with the V-shaped recesses 26 in the counter knife 14. There can be at least one cutter 30 for every rib 22. Each cutter 30 has contiguous radially outer side faces 32 that come together at a corner 34 (FIGS. 4A and 4B) and form a general V shape with the vertex of the V pointing radially outwardly. Each cutter 30 has a top face 36. The junctures between the top face 36 and the side faces 32 form edges 38. The side faces 32 and the top face 36 all come together at a cutting point 40 (which can also be regarded as the juncture between the corner 34 and the edges 38). In the embodiment depicted in FIGS. 4A and 4B, the cutter 30 is a four-sided cutter having four corners 34, each corner having a single cutting point 40. The cutter 30 is affixed to the rotor 12 in an orientation such that one corner 34 meshes with one of the V-shaped recesses 26 between teeth 24 of the counter knife. Material that is fed into the space between the rotor and counter knife is cut by the cutters 30 as they mesh with the counter knife. The cutting edges 38 are approximately orthogonal to each other, although they can have a slight curvature such that they are concave in the direction of rotation of the rotor, as shown in FIG. 3, which promotes a scissoring effect between the cutters and the counter knife; alternatively, the edges 38 can be straight. The cutters 30 are circumferentially spaced apart about the rotor so that one or more of the cutters mesh with the counter knife at a time. Each cutter 30 is mounted by a screw 42 to a tool holder 44 that is affixed to the rotor (such as by welding or bolting). The tool holders 44 are mounted within pockets 46 that are cut into the rotor surface. The cutters can be removed when damaged or dulled and can be replaced with new cutters.

As noted, the cutters 30 can have four corners 34 each of which is shaped to mesh with a groove 26 in the counter-knife 14. The cutters can be mounted to the rotor in any of four different rotational orientations each presenting a different one of the corners for meshing with the counter knife. If one corner becomes dull, the cutter can be repositioned to present a fresh corner.

While the shredder described above and illustrated in FIGS. 1 through 4 has been quite successful technically and commercially, further improvements are always being sought.

FIGS. 5 through 15 depict various embodiments of the present invention, which is characterized by the use of multi-point cutters rather than single-point cutters. FIGS. 5A and 5B depict a two-point cutter 130 in accordance with an embodiment of the invention. The cutter 130 comprises a rigid body having a plan shape as viewed along a first direction (top to bottom in FIG. 5A) that is parallel to a central axis of the cutter. The cutter 130 has a plurality of side faces 132 that come together to form corners 134, and a top face 136 that forms edges 138 with the side faces 132. Each corner 134 of the cutter defines two cutting points 140*a* and 140*b* spaced apart along the first direction.

The topmost cutting point 140*a* is formed by a juncture between the top face 136 and two contiguous side faces 132 of the cutter. The corner 134 between those side faces includes a tapered relief portion 134*a* that begins immediately at the topmost cutting point 140*a* and tapers inwardly toward the central axis of the cutter, such that the topmost cutting point 140*a* is farther from the central axis than is any part of the relief portion 134*a*. The second cutting point 140*b* is defined below the relief portion 134*a*, the second cutting point 140*b* being farther from the central axis than is a lower part of the relief portion 134*a* adjacent to the second cutting point 140*b*.

Figure 8:
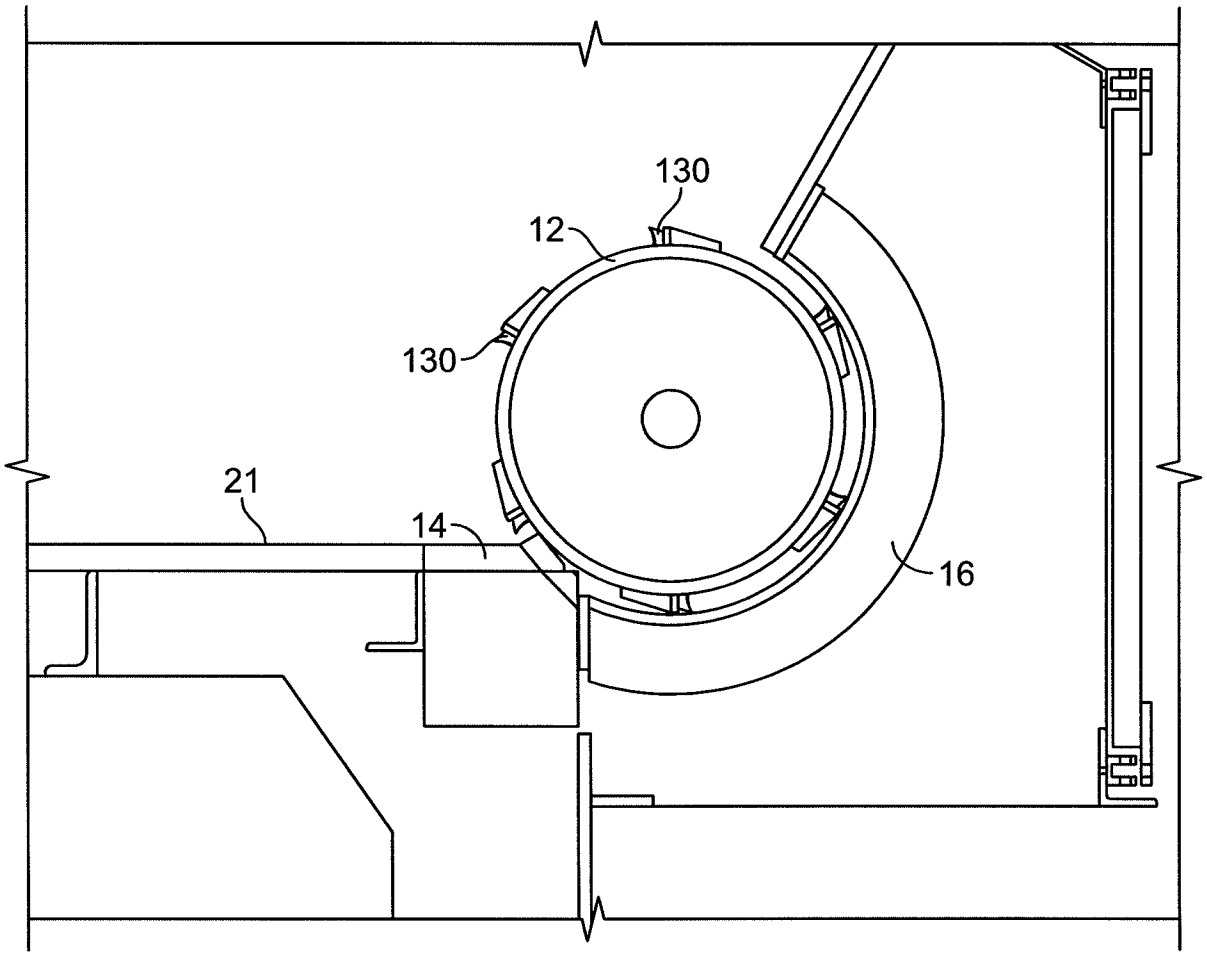
FIG. 8 is a generally schematic end view of a rotor and counter-knife similar to FIG. 2, but including two-point cutters such as depicted in FIGS. 5A and 5B.
Figure 9:
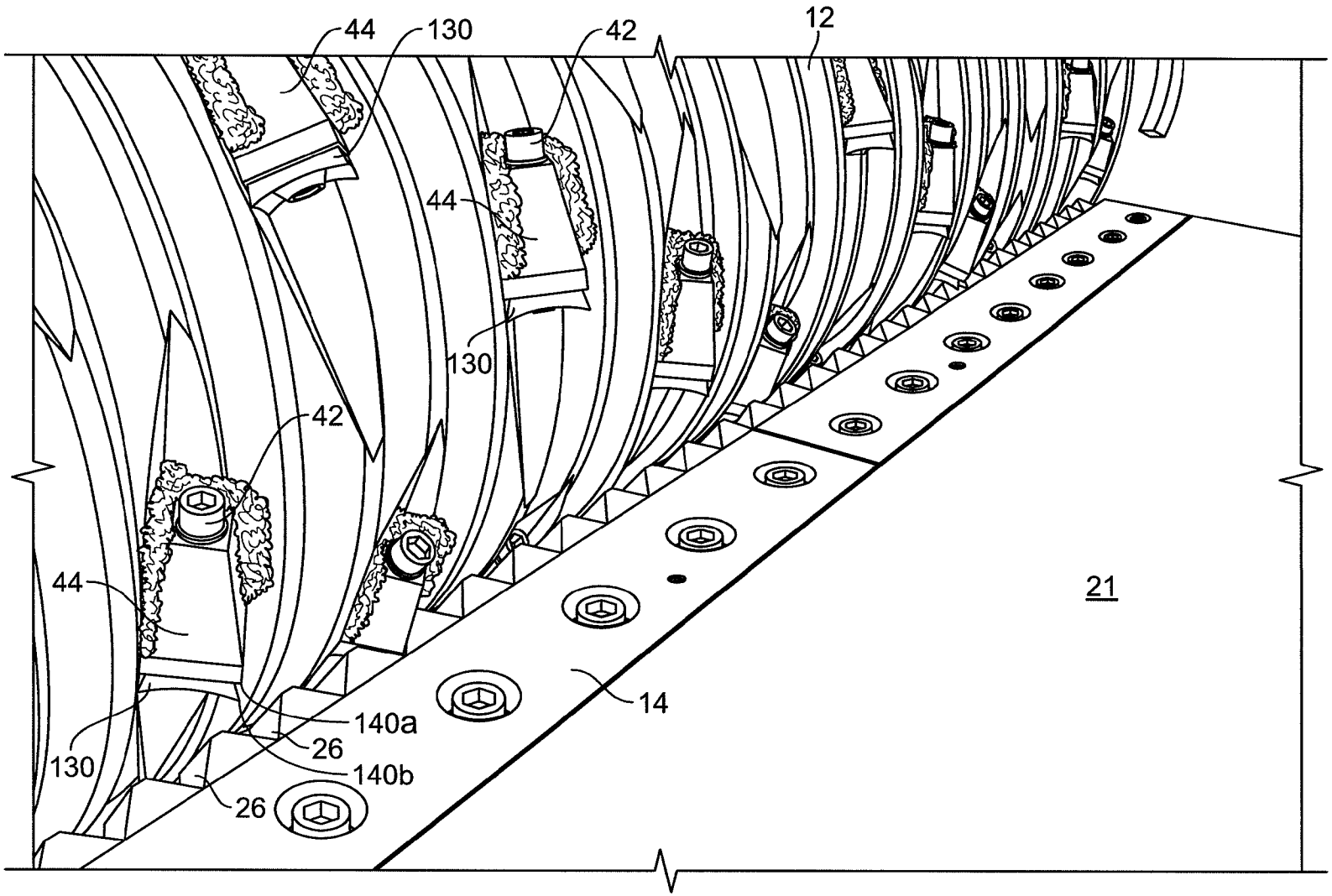
FIG. 9 is a fragmentary perspective view of a rotor and counter-knife, wherein the rotor includes two-point cutters such as depicted in FIGS. 5A and 5B.
Figure 10:
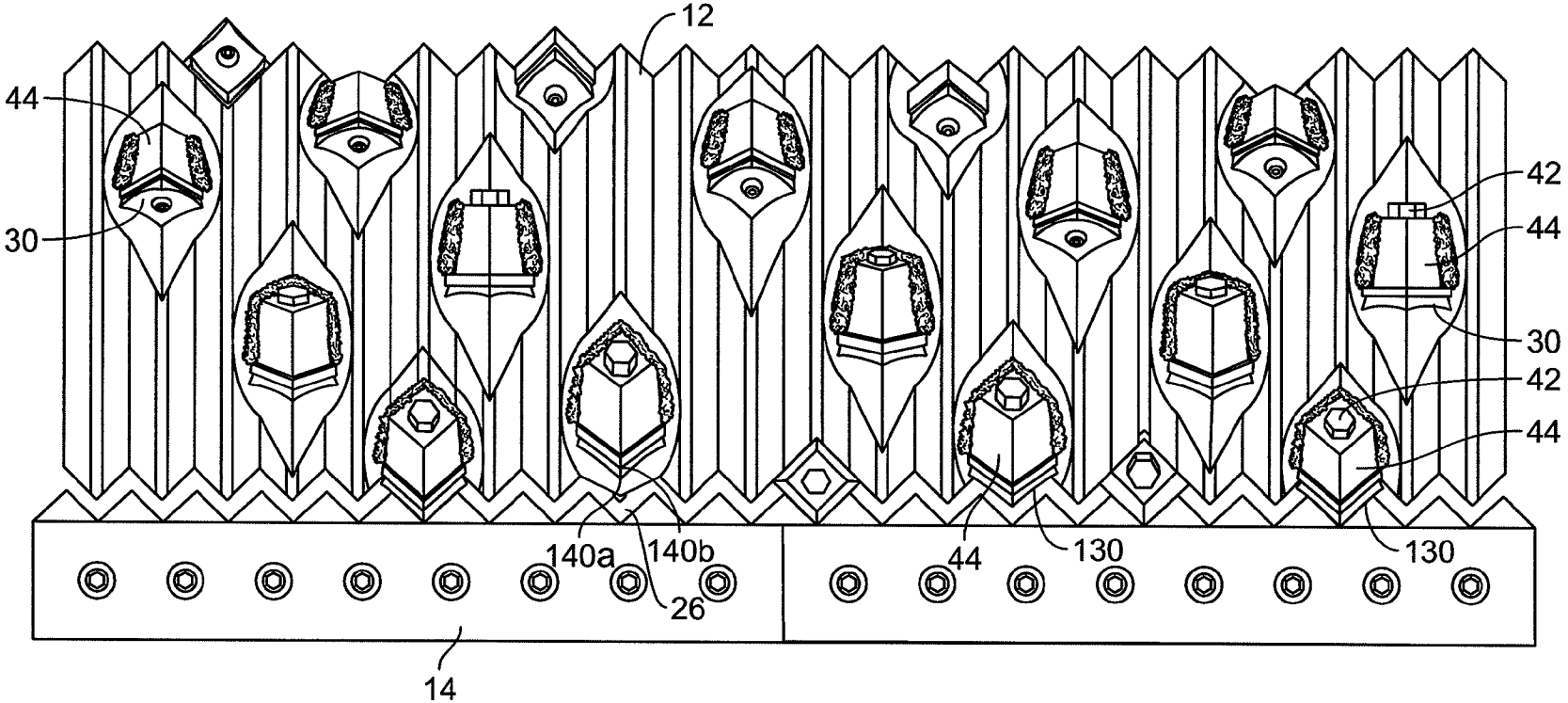
FIG. 10 is a top view of a rotor and counter-knife similar to FIG. 3, but including two-point cutters such as depicted in FIGS. 5A and 5B.

The body of each cutter 130 has a bore 142 extending through the body along the first direction for receiving a releasable fastener, and the cutter holders 44 have corresponding bores for receiving the fasteners to mount the cutters to the cutter holders 44. With reference to FIGS. 8 through 10, the cutters 130 are mounted to the rotor 12 with the central axis of each cutter 130 oriented substantially tangent to the peripheral surface of the rotor 12. The cutters are oriented such that the plurality of cutting points 140*a*, 140*b* of each cutter are arranged to sequentially mesh with the respective V-shaped groove 26 in the counter-knife 14 as the rotor rotates. Thus, the topmost cutting point 140*a* is the first to encounter the groove 26, and subsequently the second cutting point 140*b* encounters the groove 26.

It should be understood that rotors for shredders can have various configurations that differ from the illustrated rotor 12 and such rotors can include multi-point cutters in accordance with the present invention. Accordingly, the invention is not limited to the particular rotor configuration shown in the drawings.

Figure 6A:
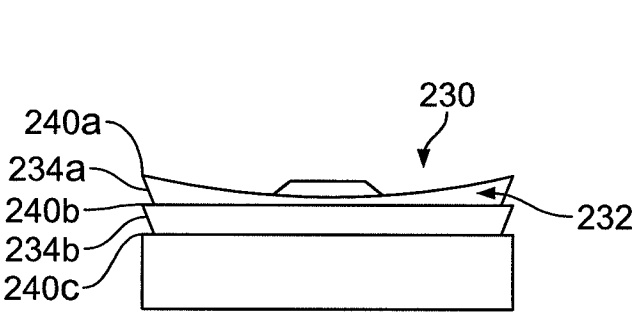
FIG. 6A and FIG. 6B are side and perspective views, respectively, of a three-point cutter in accordance with another embodiment of the present invention.
Figure 6B:
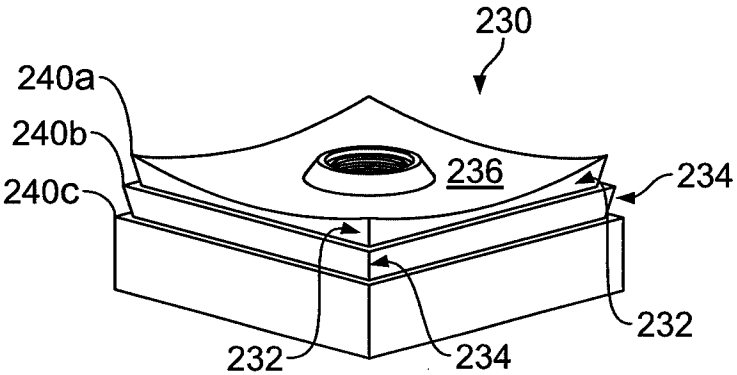

Referring now to FIGS. 6A and 6B, a three-point cutter 230 in accordance with another embodiment of the invention is depicted. The three-point cutter is generally similar to the two-point cutter 130 described above, but each corner 234 of the cutter (formed by the juncture of contiguous side faces 232) has three cutting points 240*a*, 240*b*, 240*c* spaced apart along the first direction parallel to the central axis of the cutter. The topmost cutting point 240*a* is formed by a juncture between the top face 236 and two contiguous side faces 232 of the cutter. The corner 234 between those side faces includes a tapered relief portion 234*a* that begins immediately at the topmost cutting point 240*a* and tapers inwardly toward the central axis of the cutter, such that the topmost cutting point 240*a* is farther from the central axis than is any part of the relief portion 234*a*. The second cutting point 240*b* is defined below the relief portion 234*a*, the second cutting point 240*b* being farther from the central axis than is a lower part of the relief portion 234*a* adjacent to the second cutting point 240*b*. The corner includes a tapered second relief portion 234*b* that begins immediately at the second cutting point 240*b* and tapers inwardly toward the central axis of the cutter, such that the second cutting point 240*b* is farther from the central axis than is any part of the second relief portion 234*b*. The corner further comprises a third cutting point 240*c* defined below the second relief portion 234*b*, the third cutting point 240*c* being farther from the central axis than is a lower part of the second relief portion 234*b* adjacent to the third cutting point 240*c*.

Figure 11:
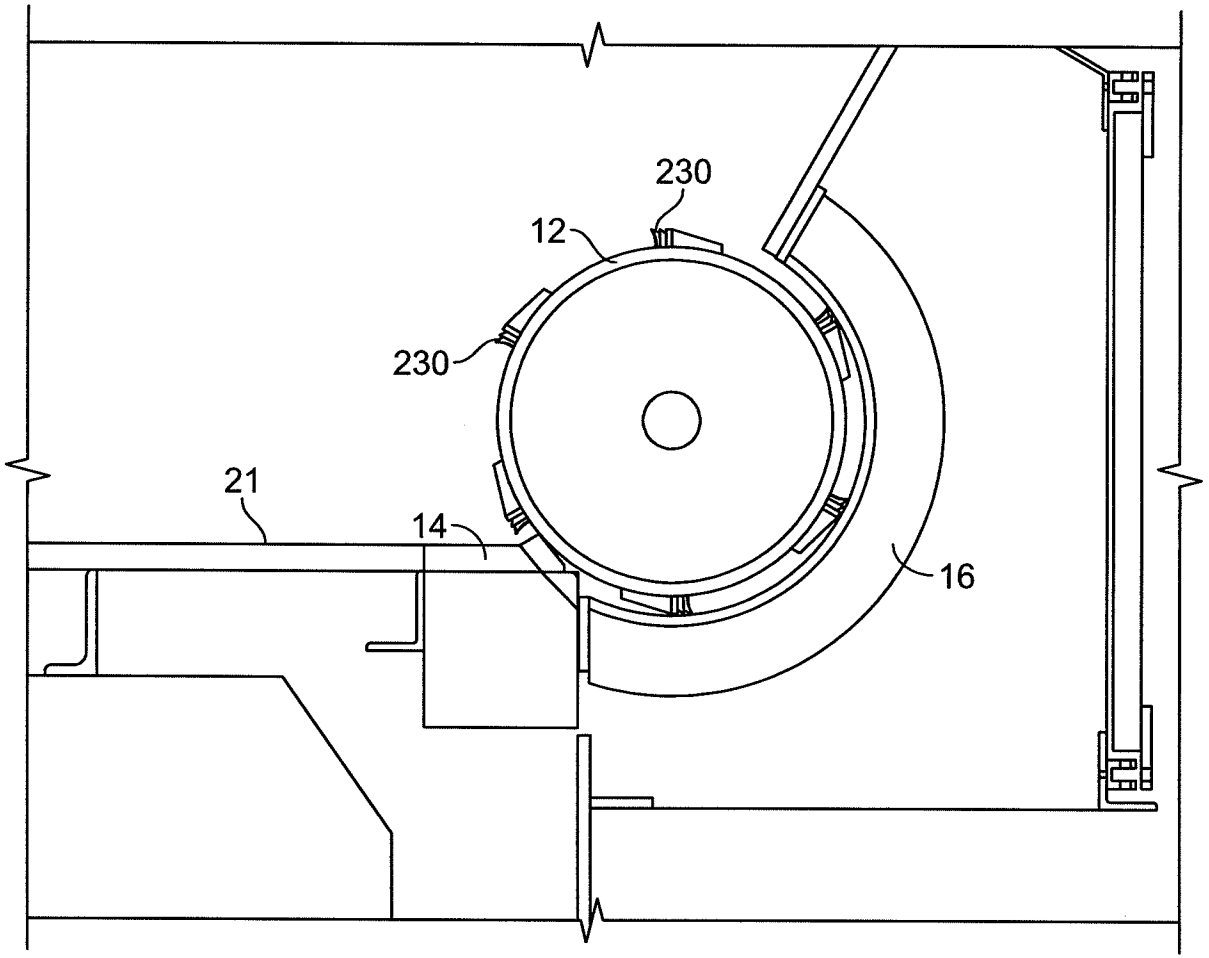
FIG. 11 is a generally schematic end view of a rotor and counter-knife similar to FIG. 2, but including three-point cutters such as depicted in FIGS. 6A and 6B.
Figure 12:
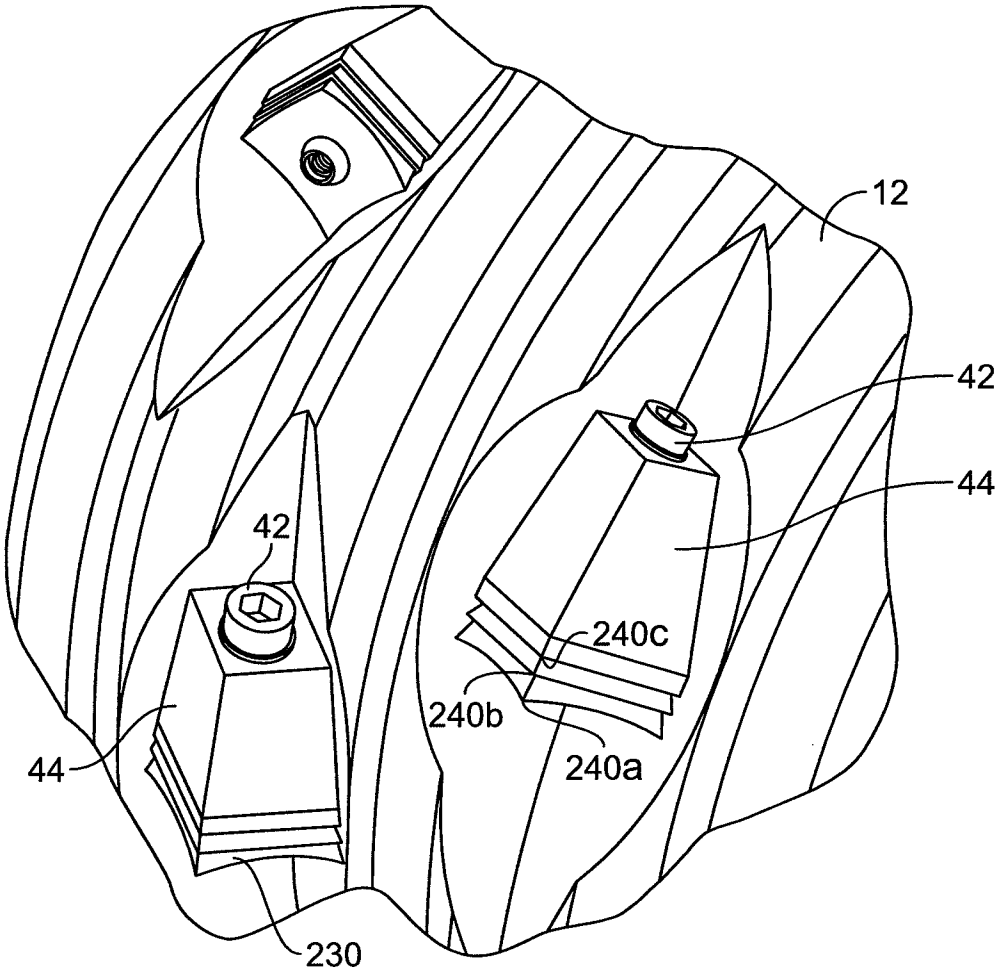
FIG. 12 is a fragmentary perspective view of a rotor, wherein the rotor includes three-point cutters such as depicted in FIGS. 6A and 6B.

With reference to FIGS. 11 and 12, the cutters 230 are mounted to the rotor 12 with the central axes oriented substantially tangent to the outer peripheral surface of the rotor, such that the plurality of cutting points 240*a*, 240*b*, 240*c* of each cutter are arranged to sequentially mesh with the respective V-shaped groove in the counter-knife 14 as the rotor rotates. Thus, the topmost cutting point 240*a* is the first to encounter the groove, subsequently the second cutting point 240*b* encounters the groove, and finally the third cutting point 240*c* encounters the groove.

Figure 7A:
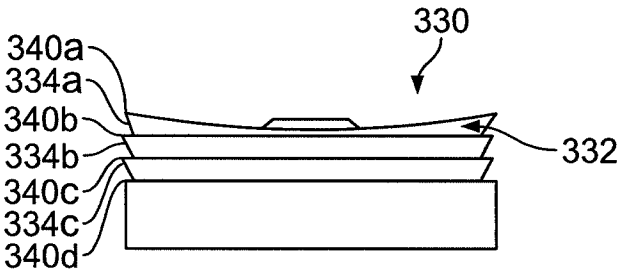
FIG. 7A and FIG. 7B are side and perspective views, respectively, of a four-point cutter in accordance with a further embodiment of the present invention.
Figure 7B:
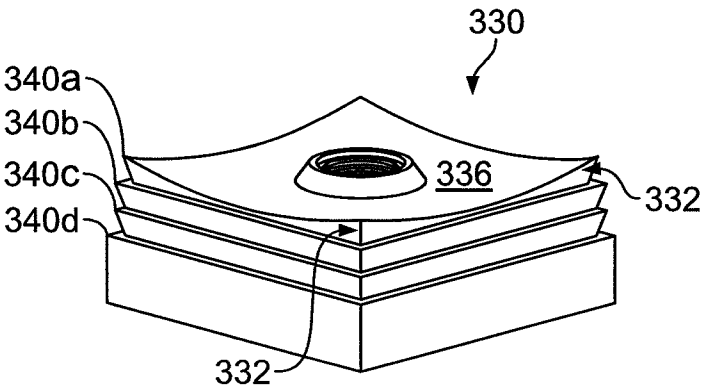

Referring now to FIGS. 7A and 7B, a four-point cutter 330 in accordance with another embodiment of the invention is depicted. The four-point cutter is generally similar to the two- and three-point cutters 130 and 230 described above, but each corner 334 of the cutter (formed by the juncture of contiguous side faces 332) has four cutting points 340*a*, 340*b*, 340*c*, 340*d* spaced apart along the first direction parallel to the central axis of the cutter. The topmost cutting point 340*a* is formed by a juncture between the top face 336 and two contiguous side faces 332 of the cutter. The corner 334 between those side faces includes a tapered relief portion 334*a* that begins immediately at the topmost cutting point 340*a* and tapers inwardly toward the central axis of the cutter, such that the topmost cutting point 340*a* is farther from the central axis than is any part of the relief portion 334*a*. The second cutting point 340*b* is defined below the relief portion 334*a*, the second cutting point 340*b* being farther from the central axis than is a lower part of the relief portion 334*a* adjacent to the second cutting point 340*b*. The corner includes a tapered second relief portion 334*b* that begins immediately at the second cutting point 340*b* and tapers inwardly toward the central axis of the cutter, such that the second cutting point 340*b* is farther from the central axis than is any part of the second relief portion 334*b*. The corner further comprises a third cutting point 340*c* defined below the second relief portion 334*b*, the third cutting point 340*c* being farther from the central axis than is a lower part of the second relief portion 334*b* adjacent to the third cutting point 340*c*. The corner includes a tapered third relief portion 334*c* that begins immediately at the third cutting point 340*c* and tapers inwardly toward the central axis of the cutter, such that the third cutting point 340*c* is farther from the central axis than is any part of the third relief portion 334*c*. The corner further comprises a fourth cutting point 340*d* defined below the third relief portion 334*c*, the fourth cutting point 340*d* being farther from the central axis than is a lower part of the third relief portion 334*c* adjacent to the fourth cutting point 340*d*.

Figure 13:
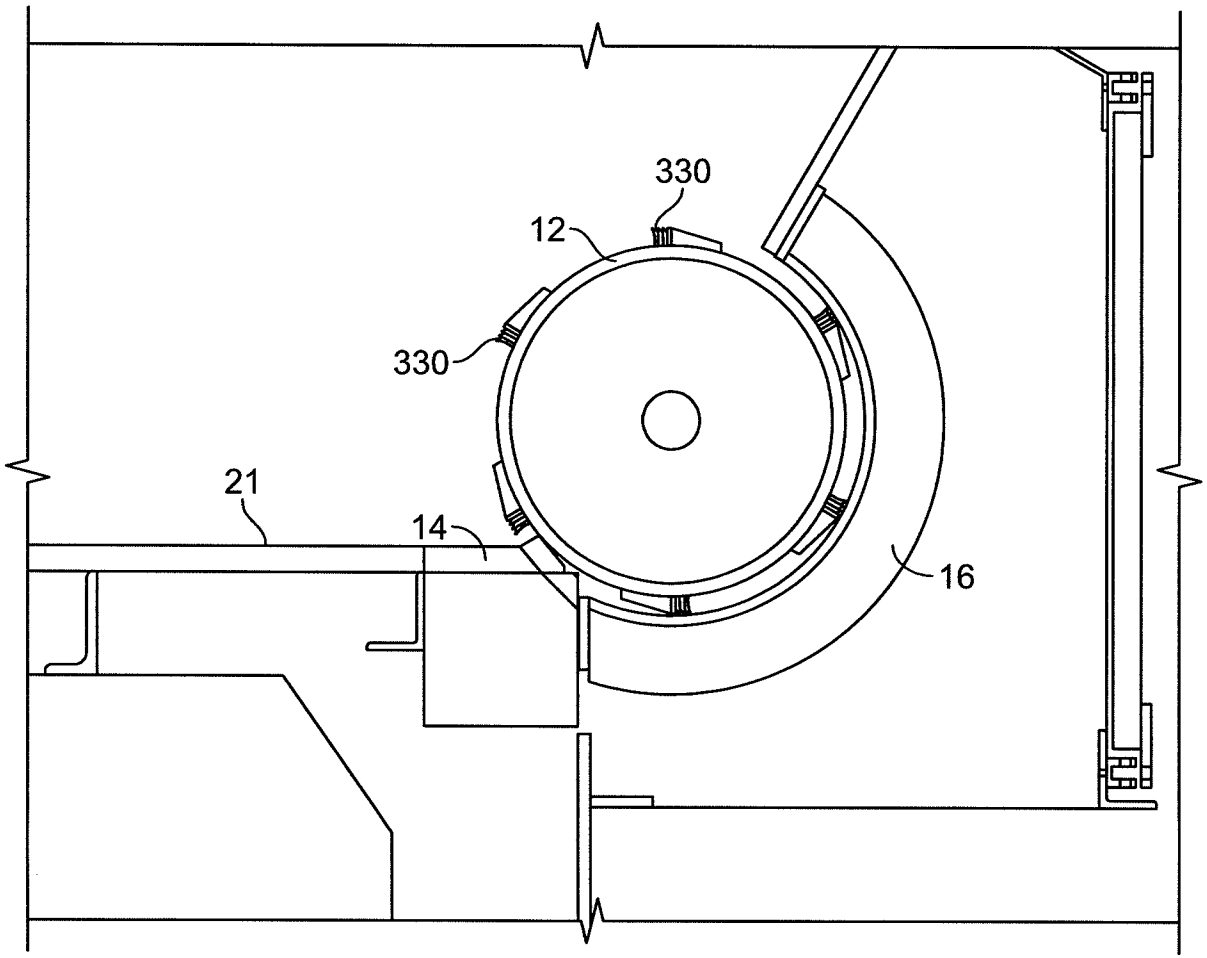
FIG. 13 is a generally schematic end view of a rotor and counter-knife similar to FIG. 2, but including four-point cutters such as depicted in FIGS. 7A and 7B.
Figure 14:
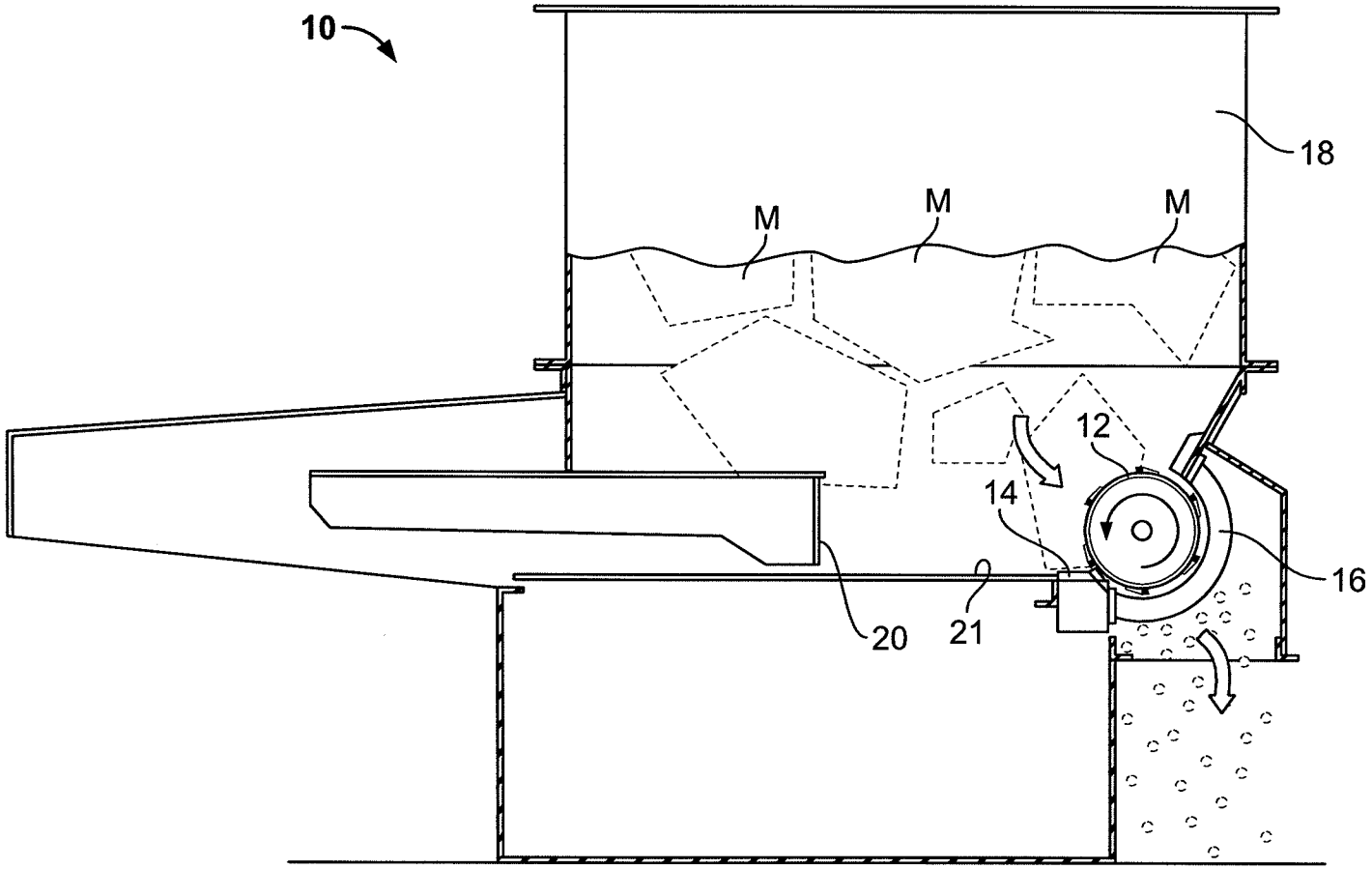
FIG. 14 is an end view, partly in section, showing a single-shaft shredder having multi-point cutters in accordance with the invention.

FIG. 13 depicts the four-point cutters 330 mounted to the rotor 12, in substantially the same manner as previously described for the other multi-point cutters 130, 230. The four cutting points 340*a-d* of each cutter encounter the respective groove in the counter-knife 14 in sequential fashion. FIG. 14 shows the shredder including the multi-point cutters, in operation. Materials M to be shredded are loaded into the hopper 18, and fall by gravity downward onto the plate 21, where they are pushed by the reciprocating ram 20 toward the space between the rotor 12 and the counter-knife 14. The multi-point cutters and counter-knife cooperate to shred the materials into pieces small enough to pass through the screen 16; pieces too large to pass through the screen are carried by the rotor's rotation back into the hopper, where they once more fall down to be shredded again.

The multi-point cutters have been found to provide distinct advantages over the single-point cutters. Tests were performed with a single-shaft shredder generally as described and illustrated above, specifically, a Vecoplan RG 70-XL shredder designed specifically for processing paper and plastic waste for reclamation and recycling, large extruder purgings, large reject parts, trim scraps, baled or loose film, synthetic fiber, carpet, wood processing scrap, medical waste, cardboard, etc. The RG 70-XL's hopper has a volume capacity of 10.25 cubic yards and a 70"×82" infeed opening. The 25" diameter rotor has 84 to 126 cutters, is powered by a 150 to 200 HP motor, turns at 125 rpm, and is fed by a 10 HP two-speed hydraulic feed ram.

A series of tests were performed with the RG 70-XL shredder, using a different cutter design in each test. Post-consumer plastic bottles were used as the material for shredding in the tests. This material was selected because it was known from previous experience that such plastic bottles are particularly wearing on standard single-point cutters. For each test, all of the cutters on the rotor were of the same design. Data (including throughput in pounds per hour) were recorded at 50, 100, 150, 200, and 250 hours of run time. All of the cutters were inspected at each 50-hour interval, photographs were taken of the cutters, and comments were recorded.

Figure 4B:
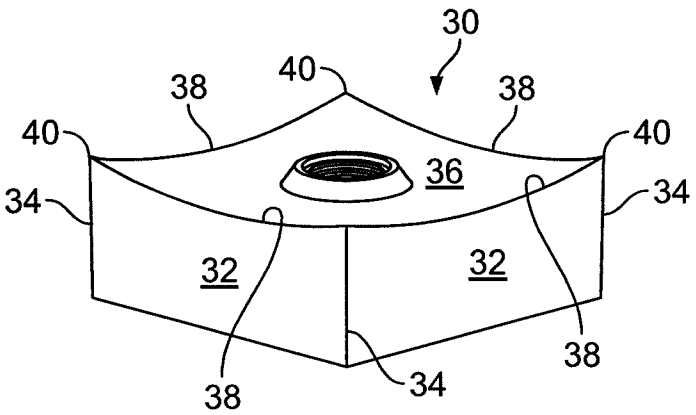
FIG. 4B (Prior Art)
FIG. 4A and FIG. 4B are side and perspective views, respectively, of one of the single-point cutters used in the shredder of FIG. 1.
Figure 5B:
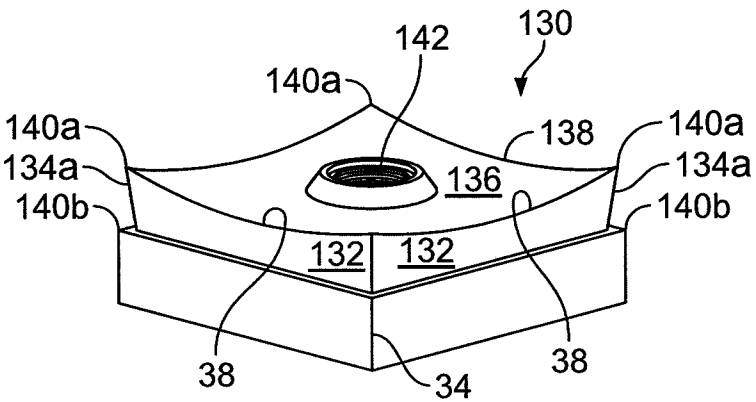
FIG. 5A and FIG. 5B are side and perspective views, respectively, of a two-point cutter in accordance with an embodiment of the present invention.
Figure 4A:
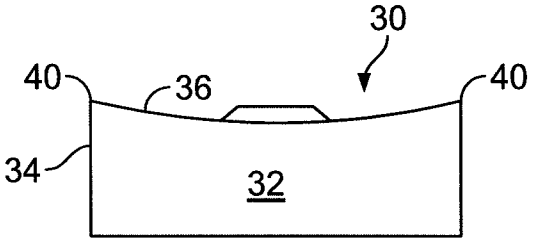
FIG. 4A (Prior Art)
Figure 5A:
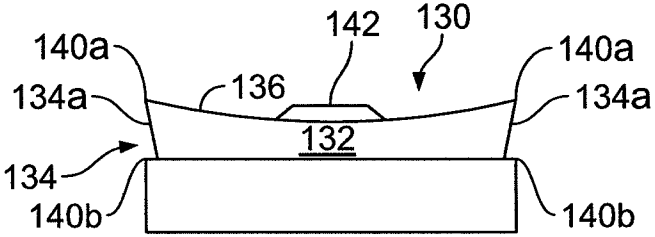

A test was performed with single-point cutters ("cutter C") substantially as illustrated in FIGS. 4A and 4B, and a another test was performed using two-point cutters ("cutter A") substantially as illustrated in FIGS. 5A and 5B. Cutters A and C were both constructed of the same D2 tool steel.

For cutter A (two-point cutter), the shredder throughput started at approximately 5300 lb/hr at t=0, and declined gradually over the first 200 hours to about 4600 lb/hr, and further declined at a slightly faster rate for the final 50 hours of the test, ending at approximately 3800 lb/hr at t=250 hours. The cutters exhibited slight wear at t=250 hours.

For cutter C (single-point cutter), throughput started at approximately 5500 lb/hr at t=0, but declined rapidly to about 2000 lb/hr at t=50 hours. Accordingly, it was necessary to rotate the cutters to present a fresh cutting corner for the next 50 hours of testing, which gave results substantially like those for the first 50 hours. The cutters were rotated again at t=100 hours, and again at t=150 hours. The test had to be terminated after 200 hours, as it was judged that the cutters would not perform much beyond 200 hours, and all four corners of the cutters had already been worn down.

The tests showed that the two-point cutters in accordance with the invention achieved a high throughput that declined quite slowly, and the cutters wore at a slow rate. In contrast, cutter C (single-point) gave dramatically poorer performance in terms of cutter wear rate.

The testing confirmed the dramatic advantage of the multi-point cutter design versus the single-point design. Indeed, all four corners of the single-point C cutters were worn down over the course of the test, while only one corner of the two-point A cutters had to be used.

Figure 15:
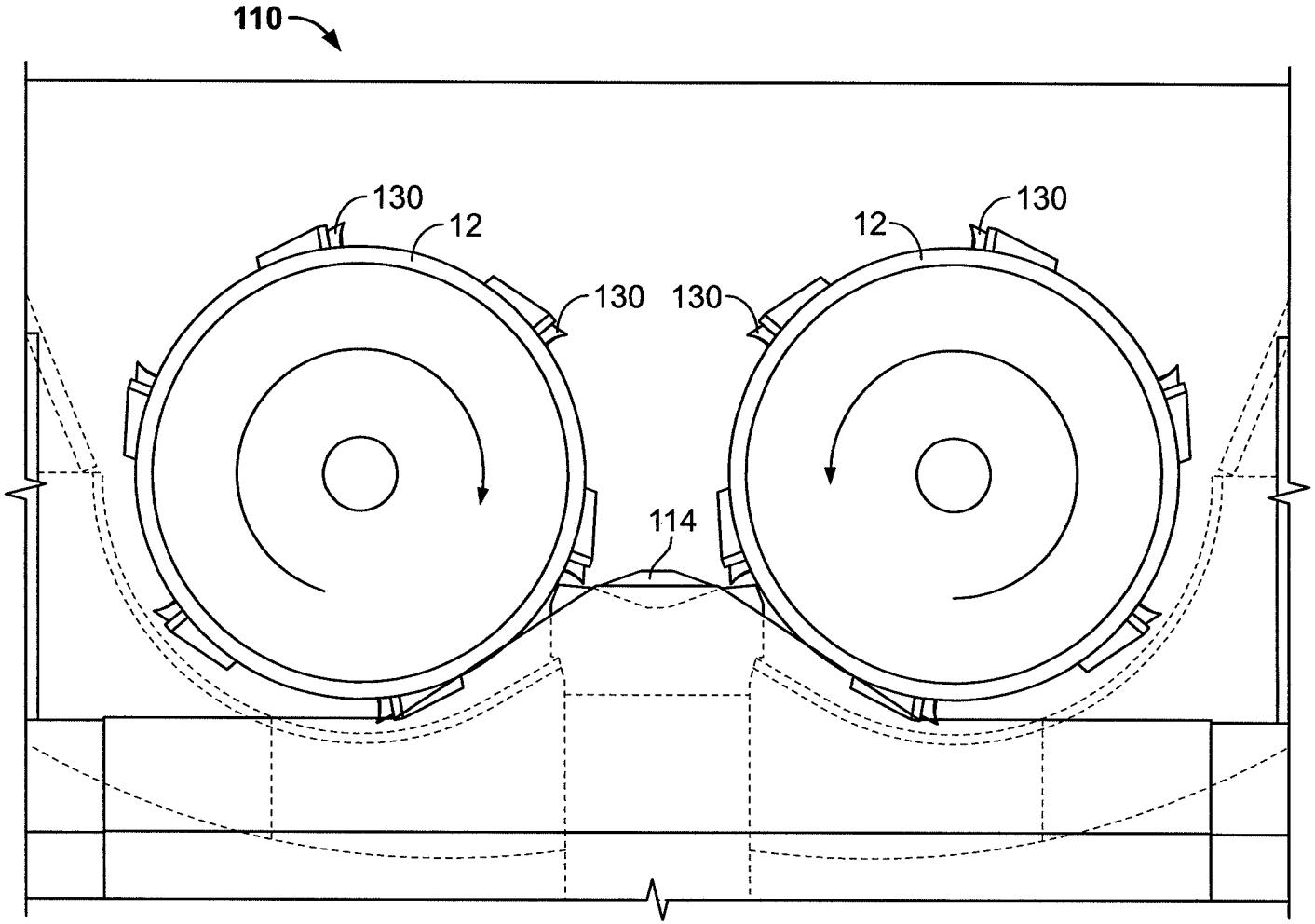
FIG. 15 is a generally schematic end view of the rotors and counter-knife of a two-shaft shredder having multi-point cutters in accordance with the invention.

As previously noted, the invention is not limited to single-shaft shredders. For example, FIG. 15 shows a two-shaft shredder 110 having a pair of rotors 12 each of which has multi-point cutters 130. The counter-knife 114 is disposed between the two rotors 12 and has a series of V-shaped grooves on each of its opposite sides for meshing with the cutters 130 of each rotor.

All of the cutters 130, 230, 330 described and illustrated herein are 4-sided polygonal (specifically, substantially square) shapes, but there is no necessity that cutters in accordance with the invention have four sides, or even be polygonal. Multi-point cutters having three sides or five or more sides, as well as non-polygonal (e.g., round) cutters, are possible.

Cutters in accordance with the invention can be made from any of various materials. Tool steels (e.g., D2, carbide, tungsten carbide, or the like, whether standard or proprietary) are suitable, for example.

This disclosure has described 2-, 3-, and 4-point cutters, but the invention is not limited to a maximum of four cutting points on a corner. Cutters having more than four cutting points are within the scope of the invention, including "serrated" cutters having substantially more than four cutting points.

Many modifications and other embodiments of the inventions set forth herein will come to mind to one skilled in the art to which these inventions pertain having the benefit of the teachings presented in the foregoing descriptions and the associated drawings. For example, the described embodiments have cutter holders that are welded to the rotor, and the cutters are removably affixed to the cutter holders by fasteners such as screws. Alternatively, however, the cutters can be affixed to the rotor in other ways. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A shredder for shredding various materials, comprising:

at least one rotor rotatable about an axis and having an outer peripheral surface that extends about the axis;

a plurality of cutter holders rigidly affixed to the outer peripheral surface of the rotor at locations spaced circumferentially apart and spaced axially along a length of the rotor;

a plurality of cutters respectively mounted to the cutter holders;

a stationary counter-knife mounted adjacent to the outer peripheral surface of the rotor and extending the length of the rotor, the counter-knife defining a plurality of generally V-shaped grooves spaced apart along the counter-knife, each generally V-shaped groove being aligned with at least one of the cutters;

wherein each of the cutters comprises a rigid body having a plan shape as viewed along a first direction, each cutter being mounted on a respective one of the cutter holders with the first direction oriented substantially tangent to the outer peripheral surface of the rotor, the body defining a corner shaped to be complementary to a respective one of the V-shaped grooves in the counter-knife, wherein the cutters are mounted in an orientation such that the corners mesh with the respective V-shaped grooves in the counter-knife as the rotor rotates about the axis; and wherein at least some of the cutters are multi-point cutters in which the corners of each cutter define a plurality of cutting points spaced apart along the first direction, the plurality of cutting points of each multi-point cutter being arranged to sequentially mesh with the respective V-shaped groove in the counter-knife as the rotor rotates.

2. The shredder of claim 1, wherein the cutters are mounted on the cutter holders by releasable fasteners permitting the cutters to be removed and replaced as needed.

3. The shredder of claim 2, wherein the body of each cutter has a bore extending through the body along the first direction for receiving a respective one of the releasable fasteners, and the cutter holders have corresponding bores for receiving the fasteners to mount the cutters to the cutter holders.

4. The shredder of claim 1, wherein the multi-point cutters include 2-point cutters in which the corner defines two cutting points spaced apart along the first direction.

5. The shredder of claim 1, wherein the multi-point cutters include 3-point cutters in which the corner defines three cutting points spaced apart along the first direction.

6. The shredder of claim 1, wherein the multi-point cutters include 4-point cutters in which the corner defines four cutting points spaced apart along the first direction.

7. The shredder of claim 1, wherein each multi-point cutter has a plurality of corners and every corner of each multi-point cutter defines a plurality of cutting points spaced apart along the first direction.

8. The shredder of claim 1, wherein each multi-point cutter has a central axis that is parallel to the first direction, wherein the corner of each multi-point cutter that meshes with the counter-knife is defined by an intersection between two contiguous side faces of the body, wherein a topmost cutting point of the cutter is defined by an intersection between the two side faces and a top face of the body all coming together at the topmost cutting point, and wherein the corner includes a tapered relief portion that begins immediately at the topmost cutting point and tapers inwardly toward the central axis of the cutter, such that the topmost cutting point is farther from the central axis than is any part of the relief portion.

9. The shredder of claim 8, wherein a second cutting point of each multi-point cutter is defined below the relief portion, the second cutting point being farther from the central axis than is a lower part of the relief portion adjacent to the second cutting point.

10. The shredder of claim 9, wherein the second cutting point extends farther from the central axis than does the topmost cutting point.

11. The shredder of claim 8, wherein the cutter further comprises a tapered second relief portion that begins immediately at the second cutting point and tapers inwardly toward the central axis of the cutter, such that the second cutting point is farther from the central axis than is any part of the second relief portion.

12. The shredder of claim 11, wherein the cutter further comprises a third cutting point defined below the second relief portion, the third cutting point being farther from the central axis than is a lower part of the second relief portion adjacent to the third cutting point.

13. The shredder of claim 12, wherein the cutter further comprises a tapered third relief portion that begins immediately at the third cutting point and tapers inwardly toward the central axis of the cutter, such that the third cutting point is farther from the central axis than is any part of the third relief portion, and a fourth cutting point of each multi-point cutter defined below the third relief portion, the fourth cutting point being farther from the central axis than is a lower part of the third relief portion adjacent to the fourth cutting point.

14. The shredder of claim 8, wherein the top face of the body is concave toward the first direction.

15. The shredder of claim 1, wherein all of the cutters on the rotor are the multi-point cutters.

16. The shredder of claim 15, wherein every multi-point cutter has a plurality of corners and every one of the corners defines said plurality of cutting points.

17. A rotor assembly for a shredder, comprising:

a rotor rotatable about an axis and having an outer peripheral surface that extends about the axis;

a plurality of cutter holders rigidly affixed to the outer peripheral surface of the rotor at locations spaced circumferentially apart and spaced axially along a length of the rotor; and a plurality of cutters respectively mounted to the cutter holders;

wherein the cutters each comprise a rigid body having a plan shape as viewed along a first direction, each cutter being mounted on a respective one of the cutter holders with the first direction oriented substantially tangent to the outer peripheral surface of the rotor, the body defining a generally V-shaped corner, wherein the cutters are mounted in an orientation such that the corner of each cutter is oriented to mesh with a respective generally V-shaped groove in a counter-knife of the shredder;

wherein at least some of the cutters are multi-point cutters in which the corners of each cutter define a plurality of cutting points spaced apart along the first direction.

* * * * *